US005813836A

United States Patent [19]

Starkweather

[11] Patent Number: 5,813,836

[45] **Date of Patent: *Sep. 29, 1998**

[54] TURBINE BLADE

[75] Inventor: John H. Starkweather, Cincinnati, Ohio

[73] Assignee: General Electric Company, Cincinnati, Ohio

[ * ] Notice: This patent issued on a continued prosecution application filed under 37 CFR 1.53(d), and is subject to the twenty year patent term provisions of 35 U.S.C. 154(a)(2).

[21] Appl. No.: 773,451

[22] Filed: Dec. 24, 1996

[51] Int. Cl.[6] ..... F01D 5/18

[52] U.S. Cl. ..... 416/97 R; 416/92; 415/173.4

[58] Field of Search ..... 415/115, 116, 415/173.1, 173.4, 173.5; 416/92, 96 R, 96 A, 97 R, 97 A, 22 A

[56] References Cited

U.S. PATENT DOCUMENTS

| | | | |
|---|---|---|---|
| 4,390,320 | 6/1983 | Eiswerth | 416/97 R |
| 5,062,768 | 11/1991 | Marriage | 416/97 R |
| 5,370,499 | 12/1994 | Lee | 416/97 R |
| 5,387,086 | 2/1995 | Frey et al. | 416/97 R |
| 5,403,158 | 4/1995 | Auxier | 416/97 R |
| 5,480,284 | 1/1996 | Wadia et al. | 416/92 |
| 5,498,133 | 3/1996 | Lee | 416/97 R |
| 5,564,902 | 10/1996 | Tomita | 416/97 R |

FOREIGN PATENT DOCUMENTS

| | | | |
|---|---|---|---|
| 0135606 | 7/1985 | Japan | 416/97 R |

*Primary Examiner*—Christopher Verdier

*Attorney, Agent, or Firm*—Andrew C. Hess; David L. Narciso

[57] ABSTRACT

A turbine blade including an airfoil section having a double-wall construction for side-wall impingement cooling on the pressure side and a multi-pass serpentine along the suction side of the blade, is described. More particularly, and in one embodiment, the airfoil section includes a pressure side wall and a suction side wall which are joined together at a leading edge and a trailing edge. The blade also includes a leading edge, or tip, and a trailing edge, or tail. The airfoil section also includes a leading edge cavity having a plurality of radial film air holes, and an inner cavity which is a three pass serpentine. As cooling air flows along the passageways, it convectively cools the portions of the turbine blade adjacent these passageways. The airfoil section further includes a trailing edge cavity to cool the trailing edge flow region of the airfoil section. A second, or double, wall is located between the pressure side wall and the inner cavity, and a plurality of impingement cavities are located between the second wall and the pressure side wall. Impingement holes provide communication between the passageways of the inner cavity and the impingement cavities. Multi-row, compound angle film holes extend from the impingement cavities so that cooling air from the impingement cavities can be discharged from the airfoil section. The double wall construction provides a more even distribution of the cooling film on pressure the side wall, which facilitates improved cooling of the airfoil section.

17 Claims, 3 Drawing Sheets

TURBINE BLADE

FIELD OF THE INVENTION

This invention relates generally to turbine blades and, more particularly, to blade strut with improved cooling.

BACKGROUND OF THE INVENTION

Turbine blades employed in gas turbines include a leading edge and a trailing edge. The leading edge is the blade surface which is first contacted by the working medium gases in the turbo-machine. The trailing edge is the blade surface which is last contacted by the working medium gases as the gases pass by the blade.

The temperatures within gas turbines may exceed 2500 degrees Fahrenheit, and cooling of turbine blades is very important in terms of blade longevity. Without cooling, turbine blades would rapidly deteriorate. Improved cooling for turbine blades is very desirable, and much effort has been devoted by those skilled in the blade cooling arts to devise improved geometries for the internal cavities within turbine blades in order to enhance cooling.

With respect to blade cooling, some known turbine blades have internal cavities forming a serpentine cooling circuit. Particularly, serpentine passages, leading edge impingement bridges, film holes, pin fins, and trailing edge holes or pressure side bleed slots are utilized for blade cooling. It would be desirable to provide improved blade cooling. In providing even better blade cooling, it also would be desirable to avoid significantly increasing the blade fabrication costs.

SUMMARY OF THE INVENTION

These and other objects are attained by a turbine blade including an airfoil section including a cooling circuit having a double-wall construction for side-wall impingement on the pressure side and a multi-pass serpentine along the suction side of the blade. This configuration is believed to provide enhanced cooling which, as described above, is beneficial.

More particularly, and in one embodiment, the airfoil section includes a pressure side wall and a suction side wall which are joined together at a leading edge and a trailing edge. The blade also includes a leading edge, or tip, and a trailing edge, or tail. The airfoil section also includes a leading edge cavity having a plurality of radial film air holes, and an inner cavity which is a three pass serpentine. Cooling air flows outwardly through a first passageway, and then turns inwardly into a second passageway. The air then turns outwardly into a third passageway. As cooling air flows along the passageways, it convectively cools the portions of the turbine blade adjacent these passageways. The airfoil section further includes a trailing edge cavity to cool the trailing edge flow region of the airfoil section. The trailing edge cavity is isolated from the inner cavity by an inner wall, and ribs separate the passageways. A rib also separates the leading edge cavity from the inner cavity. Impingement holes allow flow of cooling air from inner cavity to the leading edge cavity.

A second, or double, wall is located between the pressure side wall and the inner cavity, and a plurality of impingement cavities are located between the second wall and the pressure side wall. Impingement holes provide communication between the passageways of the inner cavity and the impingement cavities. Multi-row, compound angle film holes extend from the impingement cavities so that cooling air from the impingement cavities can be discharged from the airfoil section. The double wall construction provides a more even distribution of the cooling film on pressure the side wall, which facilitates improved cooling of the airfoil section.

In operation, cooling air flowing through the inner cavity passageways cools the suction side wall, and the cooling air also is delivered, through the impingement cavities, to the pressure side wall through the film holes. Therefore, moderately high serpentine convection is provided for the suction side wall where external heat transfer coefficients are moderate, and very high impingement convection is provided for the pressure side wall where external heat transfer coefficients are high due to high local turbulence intensity and high roughness. On the suction side wall where the film tends to persist, the film flow is discharged from the leading edge cavity to assist in cooling the leading edge. Suction side film cooling air is provided from near the leading edge, which minimizes aerodynamic mixing losses. Since the film on the concave pressure side wall tends to deteriorate within a short distance, the film is replenished by the film holes fed from the impingement cavities. The external gas velocities are low on the pressure side, so the aerodynamic penalties are small for distributing the film air over the mid-chord region of the pressure side wall via the film holes.

The low external gas velocities on the pressure side can also lead to inefficient film cooling if the coolant jets exit at too high a momentum for the gas to deflect onto the surface of wall. The impingement cavities along the pressure side minimize blow-off of the jets. The passageways must, of course, have pressure drops to drive the serpentine flow. Selecting the pressure level in each cavity to be a minimum acceptable pressure for backflow margin allows the use of the greatest number of film holes for cooling flow so coverage is improved.

The above described blade is believed to have even better cooling than at least some known blades, which facilitates extending blade life. In addition, such enhanced blade cooling configuration is not believed to result in significant additional material and fabrication costs as compared to the material and fabrication costs of some known blades.

DETAILED DESCRIPTION OF THE DRAWINGS

Figure 1:
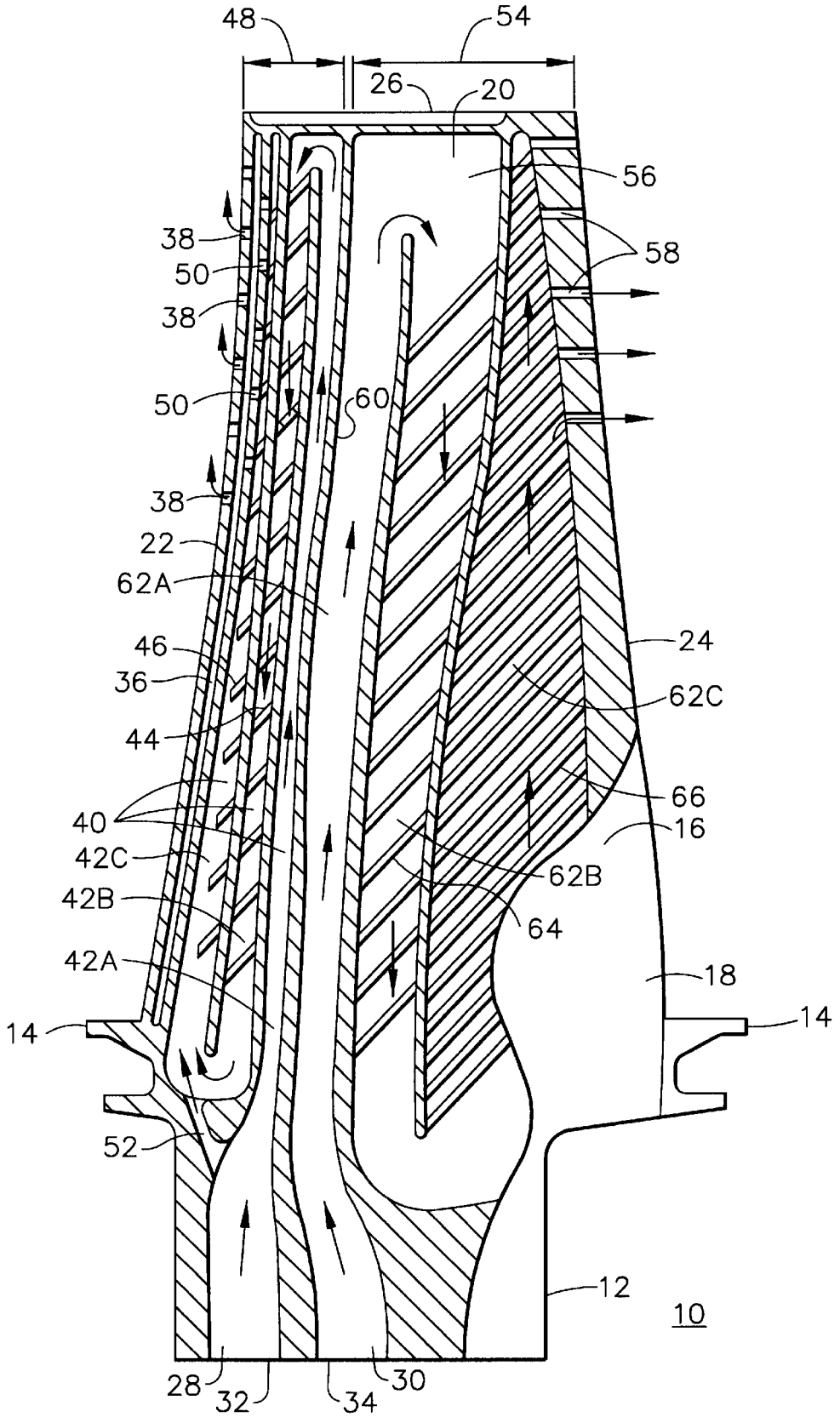
FIG. 1 (PRIOR ART)
FIG. 1 is a simplified side view of a know turbine blade including a cut-away portion which depicts known inner cooler mechanisms.

FIG. 1 is a simplified side view of a known turbine blade 10 in which most of the surface of the blade has been cut away to reveal the cooling structures. Blade 10 is generally described herein to illustrate one example of a known cooling structure. Further details regarding blade 10 are set forth in U.S. Pat. No. 5,387,086, which is assigned to the present assignee.

Blade 10 includes a dovetail section 12, a platform section 14 and an airfoil section 16. Dovetail section 12 is adapted for attachment to the rotor of a turbine shaft (not shown) or other turbine blade receiving structure in a gas turbine.

Platform section 14 forms the portion of the inner wall of the working medium flow path in a turbine. Dovetail section 12 and platform section 14 may alternatively be together referred to as the base or base section of turbine blade 10.

Airfoil section 16 extends outwardly into the working medium flow path of the turbine where working medium gases can exert motive forces on the surfaces thereof. Airfoil section 16 includes a pressure side wall 18 and a suction side wall 20 which are joined together at leading edge 22 and trailing edge 24. Blade 10 includes a tip 26. For purposes of this document, the inward direction is defined as the direction toward dovetail section 12 and the outward direction is defined as the direction toward tip 26.

A leading edge conduit 28 and a trailing edge conduit 30 provide supplies of pressurized cooling air to blade 10. An air inlet port 32, or opening, is situated at the lowermost end of leading edge conduit 28. An air inlet port 34 or opening is situated at the lowermost end of trailing edge conduit 30. Blade 10 includes a leading edge cavity 36 having a plurality of film air holes 38. Blade 10 also includes an inner cavity 40 which is coupled to leading edge conduit 28. Inner cavity 40 is a three pass serpentine which includes a passageway 42A, a passageway 42B and a passageway 42C. Cooling air flows outwardly from leading edge conduit 28 and along passageway 42A, and then turns inwardly into passageway 42B along which a plurality of turbulence promoters 44, sometimes referred to herein as turbulators or ribs, are situated. Such turbulators 44 increase the effective heat transfer efficiency. The air then turns outwardly into passageway 42C along which turbulence promoters 46 increase the effective heat transfer efficiency. As cooling air flows along passageways 42A, 42B, and 42C, it convectively cools the portions of turbine blade 10 adjacent these passageways throughout leading edge flow region 48.

As the pressurized air passes into passageway 42C of inner cavity 40, it flows through connecting holes or impingement holes 50 which couple inner cavity 40 to leading edge cavity 36. Leading edge cavity 36 is thus pressurized and cooling air flows out film cooling holes 38 to create an air film on the exterior of leading edge 22. In this manner, the exterior of leading edge 22 is film-cooled.

Blade 10 also includes a refresher air passageway 52 which directly couples coolant air from conduit 28 to passageway 42C, which is the passageway of inner cavity 40 closest to leading edge cavity 36. Refresher passageway 52 is situated adjacent platform section 14 and/or dovetail section 12, as shown. In this manner, the air which has passed through passageways 42A and 42B, and which has become warmed, is refreshed with cool air. This provides sufficient pressure in passageway 42C to prevent backflow problems and enhances cooling in the leading edge of blade 10. Leading edge cavity 36, serpentine inner cavity 40 and refresher passageway 52 together form an advanced type of modified warm bridge cooling circuit for the leading edge flow region 48 of blade 10 in which backflow problems are substantially reduced.

To cool the trailing edge flow region 54 of blade 10, trailing edge flow region 54 is provided with a trailing edge cavity 56 having a plurality of air exit slots 58 at trailing edge 24. Trailing edge cavity 56 is coupled to trailing edge air conduit 30 such that cavity 56 is supplied with cooling air. As seen in FIG. 1, trailing edge cavity 56 is isolated from inner cavity 40 by an inner wall 60 therebetween. Trailing edge cavity 56 includes serpentine passageways 62A, 62B and 62C. More particularly, passageway 62A is coupled to trailing edge air conduit 30 such that pressurized air passes outwardly through passageway 62A and then turns inwardly into passageway 62B. Passageway 62B includes a plurality of turbulence promoters 64 along its path. After passing through passageway 62B, the air turns and passes outwardly through passageway 62C which includes a plurality of turbulence promoters 66 along its path. After cooling the trailing edge flow region 54 along passageways 62A, 62B and 62C, the air exits exit slots 58.

As explained above, further details regarding blade 10 are set forth in U.S. Pat. No. 5,387,086, which is assigned to the present assignee. Although adequate blade cooling is achieved in blade 10, it would be desirable to provide even better cooling to even further extend blade life. Of course, such enhanced blade cooling preferably would be provided without significantly increasing the blade material and fabrication costs.

These objectives are believed to be achieved by various embodiments of the present invention which, in one form, includes a cooling circuit having a double-wall construction for side-wall impingement on the pressure side and a multi-pass serpentine along the suction side of the blade. Although a specific embodiment of the present invention is described below, it should be understood that many variations of such embodiment are possible.

Figure 2:
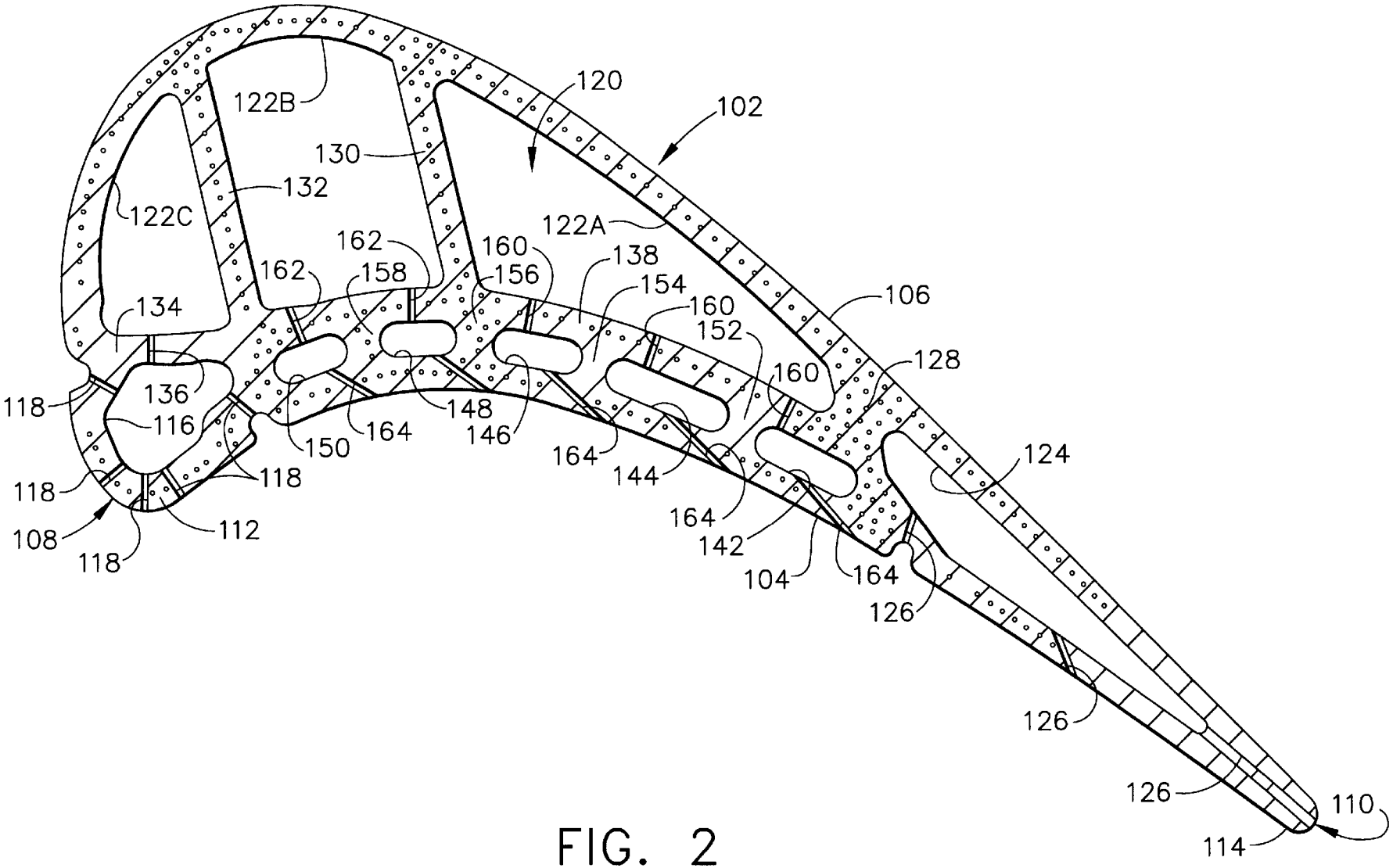
FIG. 2 is a cross-section view of a turbine blade constructed in accordance with one embodiment of the present invention.

FIG. 2 is a cross-section view of a turbine blade 100 constructed in accordance with one embodiment of the present invention. Specifically, an airfoil section 102 of blade 100 is shown in cross-section in FIG. 2. Although not shown, blade 100 includes, of course, a dovetail section and a platform section as shown in connection with blade 10 (FIG. 1).

Airfoil section 102 extends outwardly into the working medium flow path of the turbine where working medium gases can exert motive forces on the surfaces thereof. Airfoil section 102 includes a pressure side wall 104 and a suction side wall 106 which are joined together at leading edge 108 and trailing edge 110. Airfoil section 102 also includes a leading edge, or tip, 112, and a trailing edge, or tail, 114. As with blade 10 (FIG. 1), a leading edge conduit and a trailing edge conduit (not shown in FIG. 2) provide supplies of pressurized cooling air to blade 100.

Airfoil section 102 includes a leading edge cavity 116 having a plurality of radial film air holes 118. Airfoil section 102 also includes an inner cavity 120 which is a three pass serpentine including a passageway 122A, a passageway 122B and a passageway 122C. Cooling air flows outwardly through passageway 122A, and then turns inwardly into passageway 122B. The air then turns outwardly into passageway 122C. As cooling air flows along passageways 122A, 122B, and 122C, it convectively cools the portions of turbine blade 100 adjacent these passageways. As is known, and as described in connection with blade 10, turbulators (not shown) may be provided in passageways 122A, 122B and/or 122C to provide extra cooling.

Airfoil section 102 also includes a trailing edge cavity 124 to cool the trailing edge flow region of airfoil section 102. A plurality of air exit slots 126 cast with offset exits are in communication with trailing edge cavity 124, and trailing edge cavity 124 is coupled to the trailing edge air conduit (see, for example, cavity 30 for blade 10) such that cavity 124 is supplied with cooling air.

Trailing edge cavity 124 is isolated from inner cavity 120 by an inner wall 128. Ribs 130 and 132 separate passageways 122A and 122B and passageways 122B and 122C, respectively. A rib 134 separates passageway 122C and leading edge cavity 116. Impingement holes 136 allow flow of cooling air from passageway 122C to cavity 116.

With respect to the double wall construction discussed above, a second, or double, wall 138 is located between pressure side wall 104 and passageways 122A, 122B and 122C. A plurality of impingement cavities 142, 144, 146, 148 and 150 are located between second wall 138 and pressure side wall 104, and impingement cavities 142, 144, 146, 148 and 150 are separated by walls 152, 154, 156 and 158. Impingement holes 160 provide communication between passageway 122A and cavities 142, 144 and 146. Impingement holes 162 provide communication between passageway 122B and cavities 148 and 150. Multi-row, compound angle film holes 164 extend from cavities 142, 144, 146, 148 and 150 so that cooling air from cavities 142 can be discharged from airfoil section 102. As described below in connection with operation of airfoil section 102, the double wall construction provides a more even distribution of the cooling film on pressure side wall 104, which facilitates improved cooling of airfoil section 102.

Airfoil section 102 can be fabricated, e.g., cast, from a single crystal Ni alloy using the process described, for example, in U.S. Pat. No. 5,348,446, which is hereby incorporated herein, in its entirety, by reference. The entire blade surface may be coated with a thermal barrier coating. Surfaces 142, 144, 146, 148, and 150 may be textured.

In operation, cooling air flowing through passageways 122A, 122B and 122C cools suction side wall 106. The cooling air also is delivered, through impingement cavities 142, 144, 146, 148 and 150, to pressure side wall 104 through film holes 164. Therefore, moderately high serpentine convection is provided for suction side wall 106 where external heat transfer coefficients are moderate, and very high impingement convection is provided on for pressure side wall 104 where external heat transfer coefficients are high due to high local turbulence intensity and high roughness.

On suction side wall 104 where film tends to persist, the film flow is discharged from leading edge cavity 116 to assist in cooling leading edge 108. Suction side film cooling air is provided from radial flow of air from leading edge 108, which minimizes aerodynamic mixing losses.

Since the film on concave pressure side wall 104 tends to deteriorate within a short distance, the film is replenished by film holes 164 fed from impingement cavities 142, 144, 146, 148 and 150. The external gas velocities are low on the pressure side, so the aerodynamic penalties are small for distributing the film air over the mid-chord region of pressure side wall 104 via film holes 164.

The low external gas velocities on the pressure side can also lead to inefficient film cooling if the coolant jets exit at too high a momentum for the gas to deflect onto the surface of wall 104. Impingement cavities 142, 144, 146, 148, and 150 along the pressure side minimize blow-off of the jets. Passageways 122A, 122B, and 122C must, of course, have pressure drops to drive the serpentine flow. By selecting the pressure level in each cavity 142, 144, 146, 148, and 150 to a minimum acceptable for backflow margin allows the use of the greatest number of film holes 164 for cooling flow so coverage is improved.

Figure 3:
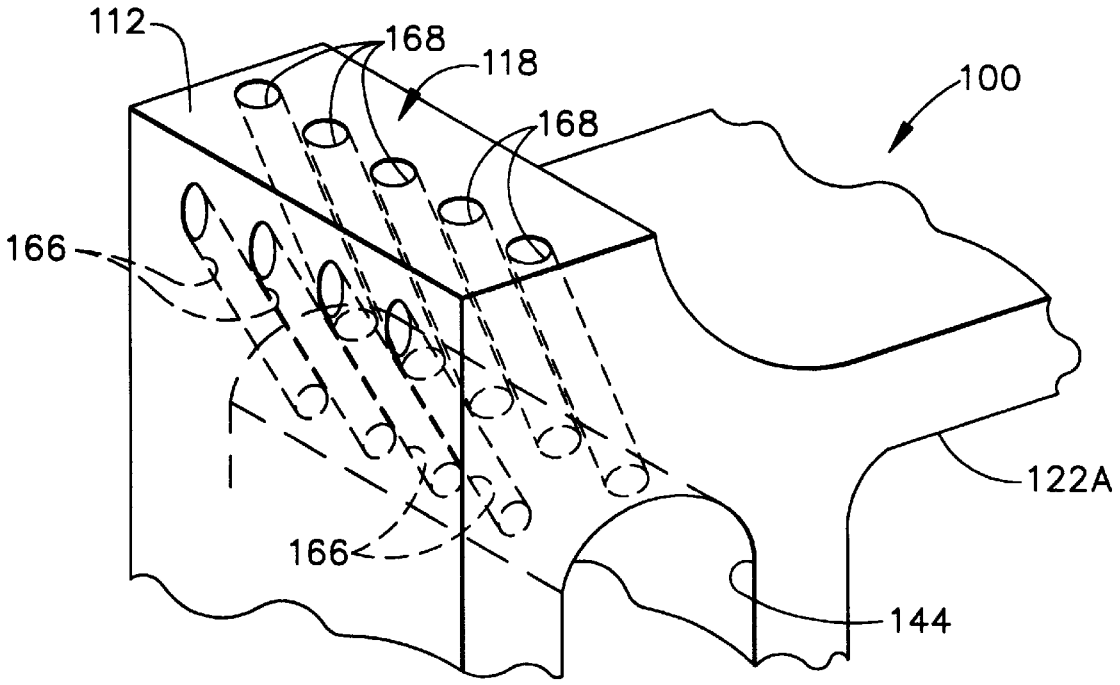
FIG. 3 illustrates the tip of the blade shown in FIG. 2.

FIG. 3 is an enlarged view of tip 112 of airfoil section 102 shown in FIG. 2. As shown, tip 112 includes a plurality of film holes 118. In FIG. 2, film holes 118 are generally categorized as pressure side tip film holes 166 and squealer tip holes 168. Warm post-impingement air flows from impingement cavity 144, for example, through holes 118. Use of such warm post-impingement air results in less thermal stress on tip 112 and provides that the heat capacity of the air is about fully utilized. Pressure side film holes 166 provide that the film temperature on pressure side wall 104 (FIG. 2) is reduced at tip 112. Further, squealer tip holes 168 provide convection cooling for tip 112 and tend to prevent leakage of air around tip 112.

Figure 4:
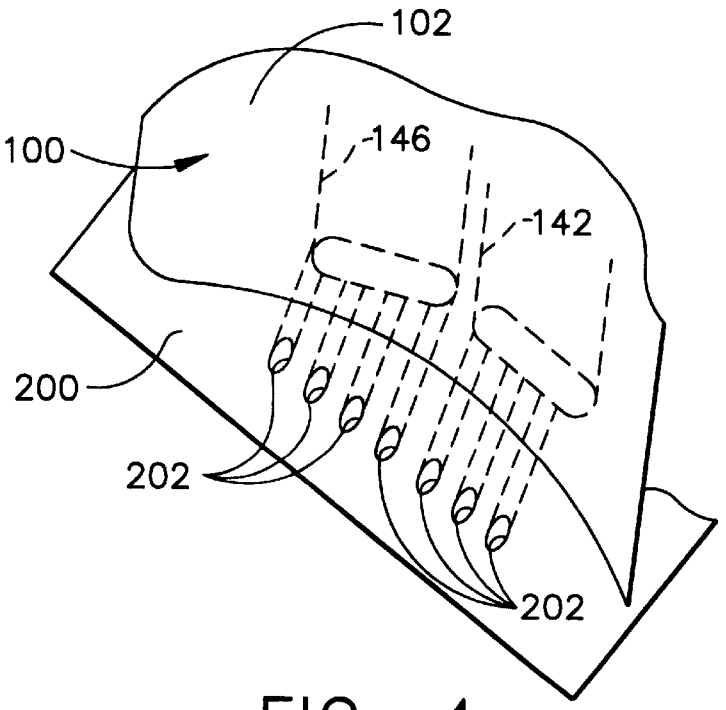
FIG. 4 illustrates a portion of one embodiment of a platform for the blade shown in FIG. 2.

FIG. 4 illustrates a portion of one embodiment of a platform 200 of blade 100 shown in FIG. 2. Platform 200 can be used as an alternative to platform 14, and platform 200 is substantially identical to platform 14. In platform 200, however, film holes 202 extend from impingement cavities 142, 144, 146, 148, and 150, at least one of which are extended radially to platform 200 through airfoil section 102. As a result, impingement cooling is provided at the location where bending stresses from the cantilevered pressure side platform are greatest. Such cooling facilitates full use of the air cooling capacity. In addition, convection cooling is provided for platform 200 and film cooling is carried from pressure side wall 104 (FIG. 2) to platform 200.

Blade 200 is believed to have even better cooling than at least some known blades, which facilitates extending blade life. In addition, such enhanced blade cooling configuration is not believed to result in significant additional material and fabrication costs as compared to the material and fabrication costs of some known blades.

From the preceding description of the present invention, it is evident that the objects of the invention arm attained. Although the invention has been described and illustrated in detail, it is to be clearly understood that the same is intended by way of illustration and example only and is not be taken by way of limitation. Accordingly, the spirit and scope of the invention are to be limited only by the terms of the appended claims.

What is claimed is:

1. A turbine blade comprising:

a base section comprising a cooling conduit and a platform; and an airfoil section comprising a pressure side wall and a suction side wall, a serpentine cooling passageway located within said airfoil section for permitting airflow from said base section cooling conduit into and through said airfoil section, a wall located between said serpentine cooling passageway and said pressure side wall, and a plurality of impingement cavities located between said wall and said pressure side wall, at least one of said impingement cavities extending radially to said platform, a plurality of film holes extending through said platform from said at least one impingement cavity.

2. A turbine blade in accordance with claim 1 wherein said airfoil section further comprises a leading edge cavity having a plurality of radial film holes, said leading edge cavity in flow communication with said serpentine cooling passageway.

3. A turbine blade in accordance with claim 1 wherein said serpentine cooling passageway comprises first, second, and third passageways configured so that at least a portion of the cooling air flows outwardly through said first passageway, and then turns inwardly into said second passageway, and then turns outwardly into said third passageway.

4. A turbine blade in accordance with claim 1 wherein said airfoil section further comprises a trailing edge cavity to cool a trailing edge flow region.

5. A turbine blade in accordance with claim 4 wherein said trailing edge cavity is isolated from said serpentine cooling passageway by an inner wall.

6. A turbine blade in accordance with claim 1 where comprising film holes extending from said impingement cavities so that cooling air from said impingement cavities can be discharged from said cavities.

7. A turbine blade in accordance with claim 1 further comprising a tip having a plurality of film holes, said film holes comprising pressure side tip film holes and squealer tip holes for discharging air from said impingement cavities.

8. A turbine blade comprising:

a base section comprising a cooling conduit and a platform; and an airfoil section comprising a pressure side wall and a suction side wall, a serpentine cooling passageway located within said airfoil section for permitting airflow from said base section cooling conduit into and through said airfoil section, a wall located between said serpentine cooling passageway and said pressure side wall, a plurality of impingement cavities located between said wall and said pressure side wall, a leading edge cavity having a plurality of radial film holes, said leading edge cavity in flow communication with said serpentine cooling passageway, and a trailing edge cavity to cool a trailing edge flow region, at least one of said impingement cavities extending radially to said platform, a plurality of film holes extending through said platform from said at least one impingement cavity.

9. A turbine blade in accordance with claim 8 wherein said serpentine cooling passageway comprises first, second, and third passageways configured so that at least a portion of the cooling air flows outwardly through said first passageway, and then turns inwardly into said second passageway, and then turns outwardly into said third passageway.

10. A turbine blade in accordance with claim 8 wherein said trailing edge cavity is isolated from said serpentine cooling passageway by an inner wall.

11. A turbine blade in accordance with claim 8 further comprising film holes extending from said impingement cavities so that cooling air from said impingement cavities can be discharged from said cavities.

12. A turbine blade in accordance with claim 8 further comprising a tip having a plurality of film holes, said film holes comprising pressure side tip film holes and squealer tip holes for discharging air from said impingement cavities.

13. A turbine blade comprising:

a pressure side wall;

a suction side wall coupled to said pressure side wall at a leading edge and a trailing edge;

an inner cavity between said pressure side wall and said suction side wall;

a trailing edge cavity;

an intermediate wall between said pressure side wall and said inner cavity, said intermediate wall extending from said trailing edge cavity; and a plurality of impingement cavities between said intermediate wall and said pressure side wall, a plurality of impingement holes providing communication between said inner cavity and said impingement cavities, and a plurality of film holes extending from said impingement cavities so that cooling air from said impingement cavities can be discharged from said blade.

14. A turbine blade in accordance with claim 13 further comprising a leading edge cavity.

15. A turbine blade in accordance with claim 14 wherein said trailing edge cavity is isolated from said inner cavity by an inner wall, and a rib separates said leading edge cavity from said inner cavity.

16. A turbine blade in accordance with claim 13 wherein said inner cavity forms a three pass serpentine.

17. A turbine blade in accordance with claim 13 further comprising a base section comprising a platform, at least one of said impingement cavities extending radially to said platform, and a plurality of film holes extend through said platform from said impingement cavity.

* * * * *